US005423543A

United States Patent [19]

Tarrant

[11] Patent Number: 5,423,543

[45] Date of Patent: Jun. 13, 1995

[54] COMBINATION BALL LIFT AND BALL MARK REPAIR APPARATUS AND MANUFACTURING METHOD

[76] Inventor: Judd Tarrant, 3210 Applewood St., Grand Junction, Colo. 81506

[21] Appl. No.: 189,326

[22] Filed: Jan. 31, 1994

[51] Int. Cl.[6] ..... A63B 53/14

[52] U.S. Cl. ..... 273/162 E; 273/162 F; 29/525

[58] Field of Search ..... 273/162 E, 162 F, 32 B, 273/32 F; 294/19.2; 29/525

[56] References Cited

U.S. PATENT DOCUMENTS

| | | | |
|---|---|---|---|
| 3,239,264 | 3/1966 | DuPont | 294/19.2 |
| 3,273,927 | 9/1966 | Carlson | 294/19.2 |
| 3,462,184 | 8/1969 | Russell | 294/19.2 |
| 3,698,720 | 11/1972 | Gudmundsen | 273/162 E |
| 3,771,794 | 11/1973 | Crockett | 273/162 F |
| 3,854,727 | 12/1974 | Alexander | 273/162 F |
| 4,787,632 | 11/1988 | Nigrelli et al. | 273/32 B |
| 4,799,684 | 1/1989 | Rango | 273/162 F |
| 4,892,314 | 1/1990 | Rango | 273/162 D |
| 4,925,190 | 5/1990 | Learned | 273/162 F |
| 4,955,609 | 9/1990 | Kassen | 273/162 F |
| 5,116,046 | 5/1992 | Pace | 273/32 B |

*Primary Examiner*—George J. Marlo
*Attorney, Agent, or Firm*—Sandeep Seth

[57] ABSTRACT

A combination golf ball lift and ball mark repair apparatus is disclosed and mounted to a handgrip end of a golf club. Ball mark repair means extends from the handgrip for lifting and turning dirt and turf to repair a ball mark with the gofer holding the golf club substantially at the clubhead end of the golf club. Ball lift means, releasably mountable upon said ball mark repair means, is provided for lifting a golf ball from a surface upon which the golf ball rests when a with the golfer holding the golf club substantially at its clubhead end. The ball lift means also acts as a protective cover for the ball mark repair means when mounted thereon. Internal mounting means is provided to rigidly mount the ball mark repair means within the hollow shaft to the handgrip end of the golf club. The ball mark repair means and ball lift means are entirely contained within an imaginary cylindrical boundary extending from the outer surface of the handgrip at parallel to a longitudinal axis of the golf club.

19 Claims, 3 Drawing Sheets

COMBINATION BALL LIFT AND BALL MARK REPAIR APPARATUS AND MANUFACTURING METHOD

TECHNICAL FIELD

The invention generally relates to golfing apparatus. The invention relates, more particularly, to golf clubs having apparatus for lifting golf balls and repairing ball marks.

BACKGROUND ART

The prior art is replete with golf club mounted apparatus. Examples of such apparatus in a search of prior art for such apparatus are disclosed in U.S. Pat. Nos. 3,239,264; 3,273,927; 3,562, 184; 3,698,720; 4,925,190; 4,787,632; 4,892,314; 4,799,684; 4,955,609 and 5,116,046.

A review of the above patents reveals that none of the apparatus disclosed therein is capable of providing for golfer a safe, durable and convenient golf club mounted device which allows the golfer to lift golf balls and to repair ball marks on a putting surface without needing to bend over. More particularly, no apparatus is disclosed in which a safely shaped ball lifting means is mounted over a ball mark repair means to allow a golfer to lift a ball without bending over and which also acts as a cover to the ball mark repair means. All of the devices disclosed, while suitable for their intended purpose, fall short of the above-stated goal. For example, U.S. Pat. No. 3,293,351 to Dupont discloses a golf club end mounted ball scoop which allows the golfer to pick up a golf ball from a ball cup without bending over. However, this device provides no means for repairing ball marks on the putting green.

U.S. Pat. No. 4,892,314 to Rango discloses a means for repairing divots, or ball marks, which is positioned within a hollow end of a golf shaft. However, the divot repair means is only kept in the shaft for storage and so the device does not alleviate the need for the golfer to bend over to repair a divot. U.S. Pat. No. 4,925,190 Learned overcomes the limitation of Rango by disclosing a combination golf club and turf repair tool in which the turf repair means is mounted on the end of a golf club such that the golf club acts as a handle extension and the golfer can repair the divot without bending over. The turf repair tool further uses a portion of the handgrip as a cover for the repair tool. The tool, however, provides no means to lift a ball from the cup. Furthermore, the mounting configuration for mounting the repair tool to the golf club is subject to failure from repeated use. Specifically, the base is subject to be pushed into the shaft from translational forces produced while repairing a ball mark (e.g., when digging into the turf). Furthermore, the base is subject to rotating or tilting in the shaft from torque forces produced while repairing a ball mark (e.g. while turning the turf), necessitating tool repair costs.

U.S. Pat. No. 4,787,632 to Nigrelli discloses a device which allows the golfer to both lift the ball from the ball cup and to repair ball marks. However, as is easily apparent, the device is cumbersome on the golf club and exposes many dangerous and potentially damaging surfaces. Furthermore, the golf club cannot be readily put into or taken from a golf bag, because of the bulkiness of the device. Finally, the device's mounting is not torque or translation force resistant.

It would be desirable if the device provided the golfer the ability, without having to bend over, to repair a ball mark and to lift a ball out of a ball cup with little or no damage to the cup. It would further be desirable if the ball lifting means could also act as a removable cover for the ball mark repair means to protect against harm and damage from the repair means. It would be a significant advantage if such a device could provide a configuration which took up no more lateral room than the golf club itself, so that a golf club outfitted with the device structure could conveniently fit in the golf bag or in any other place which the unmodified golf club could fit into. It would also be beneficial if the ball mark repair means could be mounted to the golf club with significant resistance to the torsional and translational forces generated by repairing ball marks.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

To achieve the foregoing and other objects and in accordance with the purpose of the present invention, as embodied and broadly described herein, the combination ball lift and ball mark repair device of this invention may comprise the following.

DISCLOSURE OF INVENTION

According to the invention, a combination ball lift and ball mark repair apparatus is provided for a golf club having an elongated hollow shaft, a ball striking clubhead extending from a clubhead end of the shaft, and an elongated handgrip disposed about an opposite handgrip end of the shaft. The handgrip has an outer surface and a top edge. In its broadest sense, the apparatus includes ball mark repair means and ball lift means releasably mounted on the ball mark repair means. The ball mark repair means extends from the top edge of the handgrip for lifting and turning dirt and turf to repair a ball mark when a user operates the apparatus by holding the golf club substantially at its clubhead end. The ball lift means is provided for lifting a golf ball from a surface when a user operates the apparatus while holding the golf club substantially at its clubhead end. According to an important aspect of the invention, the ball lift means also acts as a protective cover for the ball mark repair means when mounted thereon.

The apparatus further includes internal mounting means for rigidly mounting the ball mark repair means within the hollow shaft to the handgrip end of the golf club to allow the shaft to act as a handle extension which is resistant to torque and translational force produced by repairing a ball mark with the apparatus and which is sufficiently long to allow a user to operate the apparatus while the user is standing substantially upright. Preferably, the ball mark repair means and ball lift means are entirely contained within an imaginary cylindrical boundary extending from the outer surface of the handgrip at its top edge parallel to a longitudinal axis of the golf club.

In a preferred embodiment of the present invention, the internal mounting means includes an elongated insert having an outer surface and sized for being frictionally received within the hollow shaft, and a first and a second passageway longitudinally disposed along the insert. The ball mark repair means includes a pair of elongated prong members which each have a first portion frictionally disposed within one of the longitudinal passageways and a second portion which extends from said first portion a selectable length beyond the handgrip. The second portions provide poking surfaces for lifting and turning dirt and turf. The ball lift means includes a base portion having a pair of bores therein. The bores are located and configured to frictionally receive one of the second portions such that said base portion is mountable upon the second portions generally flush with the edge of the handgrip. The ball lift means is provided with an arcuate ball lifting surface integral with the base portion to lift a golf ball thereon.

Preferably, each of the second portions extends away from the longitudinal axis of the shaft in a direction opposite to the direction in which the clubhead extends from the longitudinal axis of the shaft, and each of the bores extends in the same direction as the second portions. The arcuate lifting surface faces the same direction in which the clubhead extends. In this preferred but non-exclusive configuration, the user thus repairs the ball marks while holding the golf club at the clubhead end with the clubhead pointing towards the user and lifts a ball from a ball cup while holding the club at the clubhead end with the clubhead pointing away from him.

In accordance with an important aspect of the present invention, the internal mounting means cooperates with the ball mark repair means to provide torsional and translation durablity of the apparatus against forces it experiences while a ball mark is being repaired. Translational durability is provided by using a positive stop defined within the hollow shaft where the inner wall of the hollow shaft narrows to provide the positive stop. Positive stop is defined herein as a point or surface of rigid translational resistance. The internal mounting means, in the form of an insert, is sized longitudinally such that its first end abuts the positive stop to prevent it from being unwantedly pushed into the hollow shaft. To provide the torsional resistance the passageways adjoin the outer surface of the insert and each of the prong first portions is sized to partially laterally extend beyond the outer surface of the insert and frictionally engage the inner wall of hollow shaft.

The foregoing, in combination with a conventional golf club, provides a novel golf club assembly of the present invention which provides the golfer the ability to pick up golf balls and repair ball marks while being convenient and safe because the ball lifting means also acts as a safe cover for the ball mark repair means. Furthermore, the apparatus is not cumbersome, and does not affect the ability of the golfer to store his golf club in a golf bag or golf club tube.

The present invention also provides a method of manufacturing a golf club assembly which includes the step of providing a conventional golf club having an elongated hollow shaft having an inner wall, a clubhead end and an opposed handgrip end, a clubhead extending from the clubhead end and a handgrip disposed about the handgrip end. The method further includes providing an elongated insert having an outer surface, first and second opposed ends, and a pair of channels longitudinally disposed along the insert in communication with the insert outer surface. The method further includes providing a pair of elongated prong members, each prong member having a first portion extendable into one of the passageways and a second portion extending from the first portion to provide a poking surface for lifting and turning dirt and turf. The insert is inserted by its first end, into the handgrip end of the hollow shaft so that the insert is rigidly positioned in the hollow shaft with its first end within the shaft and its second end generally adjacent to the handgrip end of the shaft.

The first portion of each of the prong members is inserted into one of the passageways so that the first portion is rigidly positioned in the passageway with the second portion extending beyond the handgrip end of the golf club. The method further includes providing ball lift and prong cover means for lifting a golf ball and for covering the second portions of said prong members to prevent injury and damage when mounted onto the prong members. The method further includes mounting the ball lift and prong cover means over the prong members.

Preferably, the steps of inserting the first portion and mounting result in the ball mark repair means and the ball lift means being entirely contained within an imaginary cylindrical boundary extending from the outer surface of said handgrip at the handgrip's top edge generally parallel to a longitudinal axis of the handgrip. Preferably, the step of inserting the insert includes abutting the first end of the insert against a positive stop defined within the hollow shaft. The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

Figure 1:
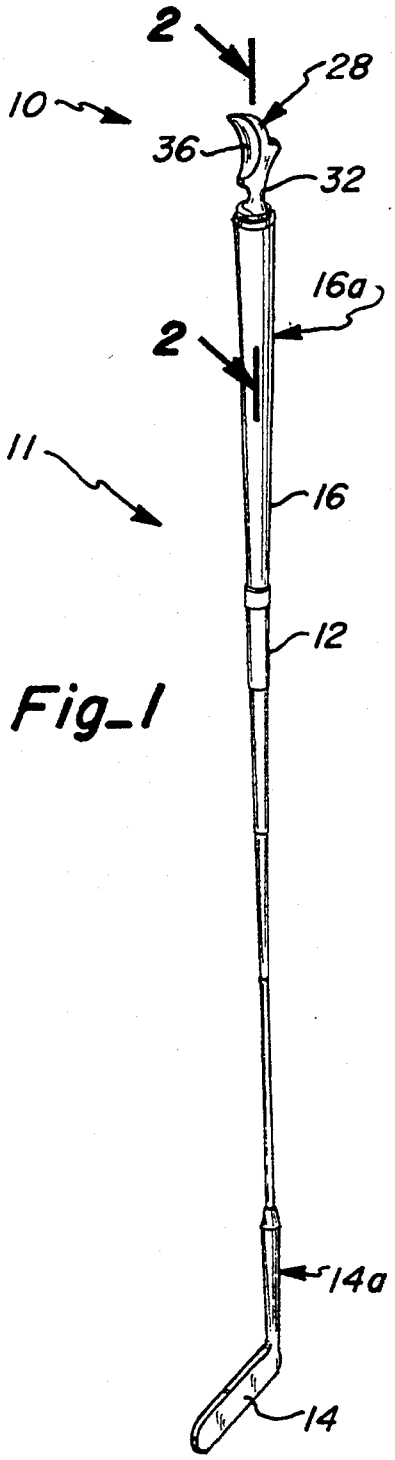
FIG. 1 is a perspective view illustrating a golf club assembly of the present invention having a combination ball lift and ball mark repair apparatus.
Figure 2:
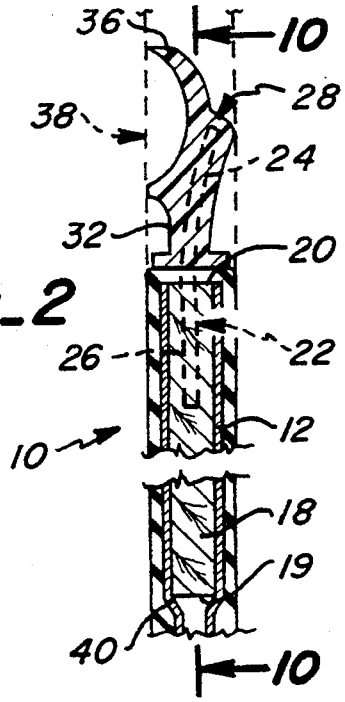
FIG. 2 is a partial vertical section, taken along the line 2—2 in FIG. 1, illustrating the insert means and other parts of the combination apparatus.

FIGS. 1-10 illustrate a combination ball lift and ball mark repair apparatus 10 of the present invention used as part of a golf club assembly 11 having a hollow shaft 12 to which a conventional clubhead 14 is attached at a clubhead end 14*a* thereof. The clubhead.14 is a conventional putter type typically used in the final part of play in a round of golf to sink a golf ball 30 into a golf ball cup 31 located in the ground on a putting green. The golf club assembly 11 includes a conventional type handgrip 16 tightly frictionally mounted over a handgrip end 16*a* of the shaft 12. The shaft 12, the clubhead 14 and the handgrip 16 and the shaft 12 are made from conventional suitable materials. As shown in FIG. 1, the shaft 12 is illustrated[comprised of successive segments of slightly reduced diameter but may also be of a continuously taper.

Figure 3:
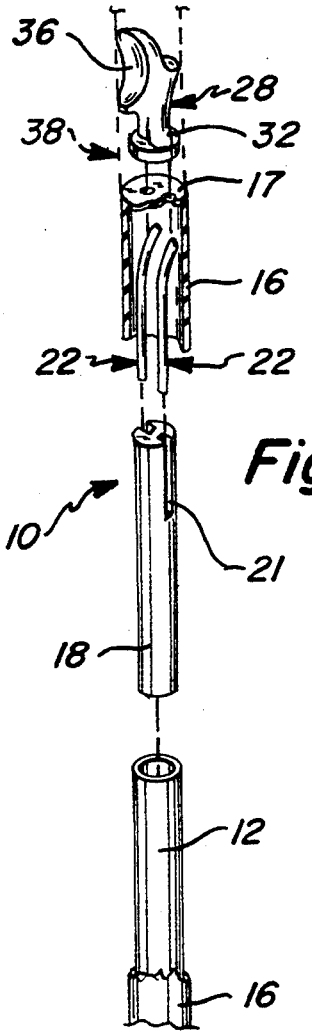
FIG. 3 is a partial exploded perspective view, illustrating the primary elements of the present invention.
Figure 9:
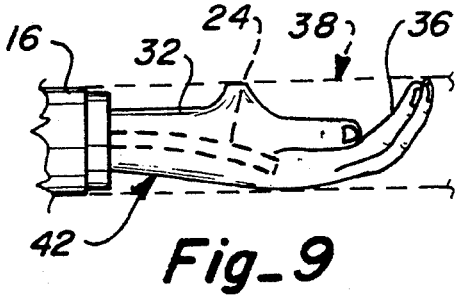
FIG. 9 is a side elevation view illustrating a ball lift and cover means having an ornamental hand shape.

As best shown in FIG. 3, the apparatus 10 is mounted to the shaft 12 at the handgrip end 16*a* and extends past the top edge 17 of the handgrip 16. The apparatus 10 includes an elongated insert, or internal mounting means, 18 which is made of a suitably rigid material, preferably wood. The diameter of insert 18 is substantially equal to the internal diameter of the shaft 16 for the portion of the shaft within which the insert 18 is disposed, so that the insert 18 has a tight frictional fit within the shaft 16 to maintain it in a substantially rigid relationship therein. The insert 18, from first end 19 and to second end 20 has a longitudinal length such that, in place, the first end 19 abuts a positive stop (40) in the shaft, as will be described herein, and the second end 20 is substantially aligned with the top edge 17 of the handgrip 16. The insert 18 is preferably cylindrical and contains a pair of passageways 21 which run a selected length along its longitudinal direction from the second end 20 to a terminal end between the second end 20 and the first end 19. The passageways 21 receive a pair of prong members 22, and are preferably disposed as semicircular channels along the outer surface (not numbered) of the insert 18.

The prong members 22 comprise the ball mark repair means of the apparatus 10 and each consists of a first portion 26 and a second portion 24. Each of the first portions 26 is preferably cylindrical and generally straight, having a radius corresponding to the radius of its respective semi-circular channel 21 to be frictionally received and rigidly housed therein. The purpose of the first portions 26 is to rigidly connect the prong members 22 to the insert 18 and to increase rigid engagement of the ball mark repair means with the inner wall of the shaft 12. The radius of each first portion 26 is sufficiently small such that, when placed in its respective slot 21, the first portion 26 extends laterally a slight amount beyond the outer surface of the insert 18 and slightly deforms the hollow shaft 12 by pressing against the inner wall (not numbered) of the shaft 12. The shaft 12 is thus pressed into a slightly elliptical configuration by the first portions 26. It is important to the practice of this invention that the insert 18 and the prong members 22 be able to resist torsional forces and translational forces exerted upon them during the course of repairing a ball mark. The added tightness to the fit created by the prong members 22 pressing up against the inner wall of the shaft 12 creates a sufficient amount torsional resistance. Also, the first portion 26 are of a length corresponding to the selected length of the channels 21, so that each first portion 26 abuts against the terminal end of its respective channel 21. By so abutting, the prong members 22 have sufficient resistance to translational forces created upon them while ball mark repair is taking place. From the foregoing, it can be seen that the shaft 12 thus acts as a torsion and translation force resistant handle extension of the apparatus 10.

Each of the second portions 24 integrally extends a selectable length from its respective first portion 26 so that each prong member 22 is preferably one continuous piece comprised of, preferably, a high tensile strength metal such as stainless steel. The second portions 24 provide the poking surfaces of the ball mark repair means and are preferably cylindrical to facilitate aeration of turf soil when inserted into the ground during ball mark repair. Unlike the first portions 26, as best seen in FIGS. 2, 3, 6,and 8, the second portions 24 are not straight but rather arcuately shaped and extend, in place, in a direction opposite to the direction in which the clubhead 14 extends. As will be described herein, this "extending away" orientation of the second portions 26 is preferable to facilitate ball mark repair because the prongs are more easily seen by the user and there is increased lever action. However, neither the "extending away" orientation, nor the arcuate contour, nor the cylindrical cross-sectional shape is necessary to the basic functioning of the apparatus; the prongs may be flat, or could extend straight upright or in the direction of the clubhead 14.

The apparatus is also provided with a ball lift and prong cover means 28 which includes a prong receiving base portion 32 having a pair of bores (not numbered) housed within the base portion 32. The bores are spaced within the base portion 32 with a corresponding spacing as of the second portions 24. The bores are generally shaped (cylindrical, in the case of cylindrical prong members 22, as here) and sized to frictionally receive their respective second portions 24. The bores are also contoured to match the contour of the second portions 24 and extend in the same direction as their respective second portions a length approximately equal to the selected length of their respective second portions 24. Thus, when the base portion 32 is mounted on the prong member second portions 24, the base portion 32 lies substantially flush with the top edge 17 of handgrip 16. However, the ball lift/prong cover means 28 is meant to be easily manually separated from the prong members 22, so that the ball lift/prong cover means 28 is removably mountable on the prong members 22. The bore-prong member fit should only be sufficiently tight to prevent the ball lift/prong cover means 28 from easily slipping off of the prong members 22.

The ball lift/prong cover means 28 also includes an arcuate ball lifting surface portion 36 integrally formed with the base portion 32. The lifting surface portion 36 is preferably configured so that its arcuate lifting surface has a curvature equal to the curvature of a conventional golf ball 30 and faces in the same direction as the clubhead 14, with the prong members 22 disposed behind the lifting surface. In this manner, the ball lift/-prong cover means is sized and configured such that no portion of it, when mounted upon the top end 17 of the handgrip 16, crosses an imaginary boundary defined by an imaginary cylindrical surface 38, extending from the outer surface (not numbered) of handgrip 16 at its top edge 17 and generally parallel to the longitudinal axis of shaft. For the purposes herein, longitudinal axis of shaft is defined as the axis connecting all cross sectional center points in the hollow shaft 12. Thus, the apparatus 10 allows the golf club assembly 11 to fit within a golf club tube in a golf club bag, so that the golf club assembly does not have to be externally mounted to the golf bag. It will also be appreciated that the ball lifter/cover means 28 protects the bag from any damage which could otherwise be created by the prong members 22 and also protects against personal injury otherwise arising from contact with the prong members 22. It will be noted that the configuration of the ball lift/prong covering means may be altered, as to the configuration 42 shown in FIG. 9, for example, as long as the configuration meets two criteria: (1) that it not break the imaginary boundary 38; and (2) that its lifting surface allow for the golf ball 30 to be scooped thereon. It is not essential, however, to the functioning of the apparatus that the lifting surface face in the direction of the clubhead 14. In a lesser embodiment, the second portion could extend arcuately in the same direction as the clubhead 14, in which case the lifting surface would face away from the clubhead 14. Also, if the second portions 24 were to extend straight rather than arcuately, there may be sufficient mounting room to have the lifting surface face either way. The ball lift/prong cover means 28 is preferably comprised of a hardened plastic material which safely covers the second portions 24 when mounted thereon.

It will be noted that the insert 18 abuts the positive stop 40 made by reduction of the shaft's 12 diameter. This prevents the insert 18 from being pushed deeper into the shaft 12 by translational forces (e.g. pushing) created during ball mark repair and thus maintains the durability of apparatus 11. If the insert 18 is not properly catching on the positive stop 40, or if it is too short to reach the positive stop, a spacer insert (not shown), which may be of a harder, slightly wider material or may be simply a smaller piece of insert material, may first be inserted to the positive stop 40 and the insert 18 could located abutting the spacer.

Figure 5:
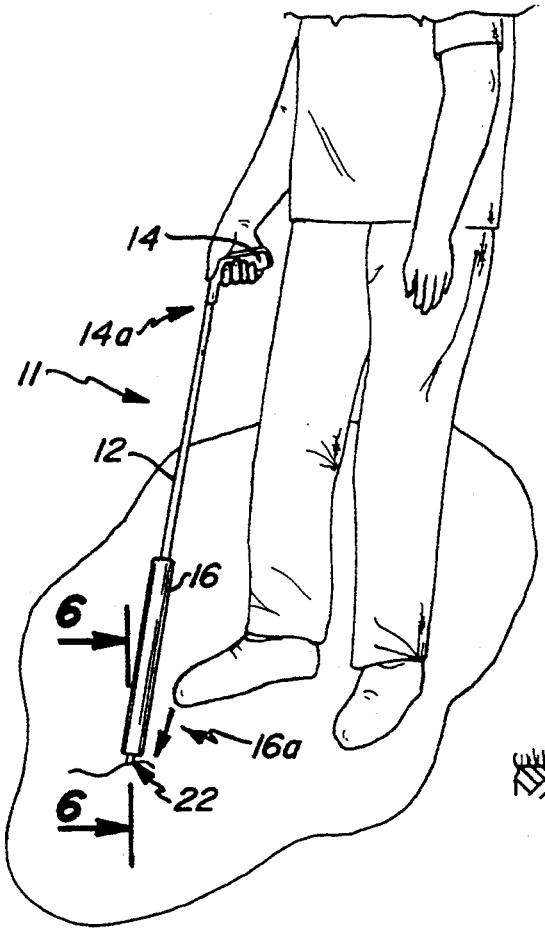
FIG. 5 is a partial perspective view illustrating a golfer repairing a ball mark with the clubhead pointing towards the golfer
Figure 6:
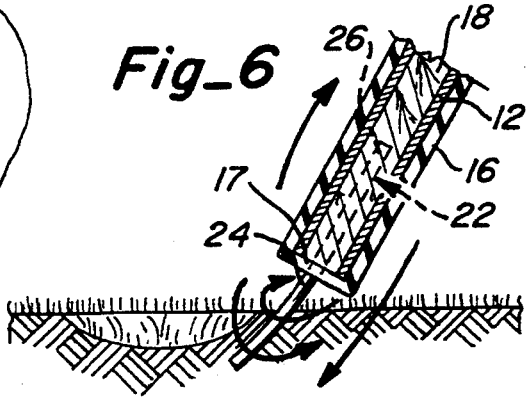
FIG. 6 is an enlarged partial vertical section, taken along the line 6—6 in FIG. 5, illustrating ball repair motions resulting in torque and translational forces.
Figure 8:
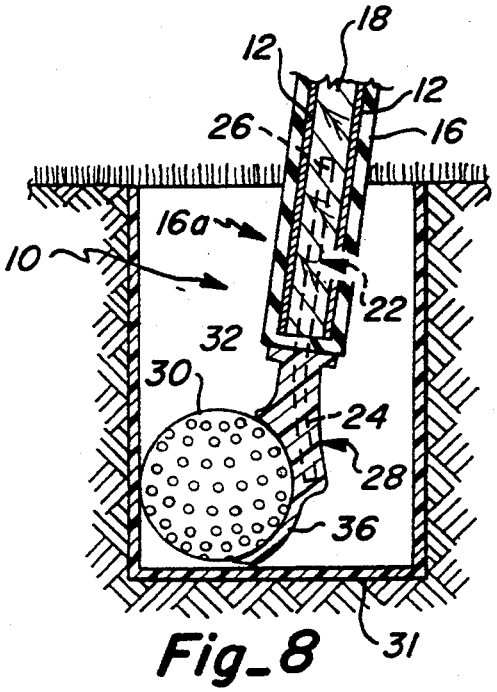
FIG. 8 is a partial vertical section, taken along the line 8—8 of FIG. 7, illustrating the ball lifting means lifting a ball.
Figure 7:
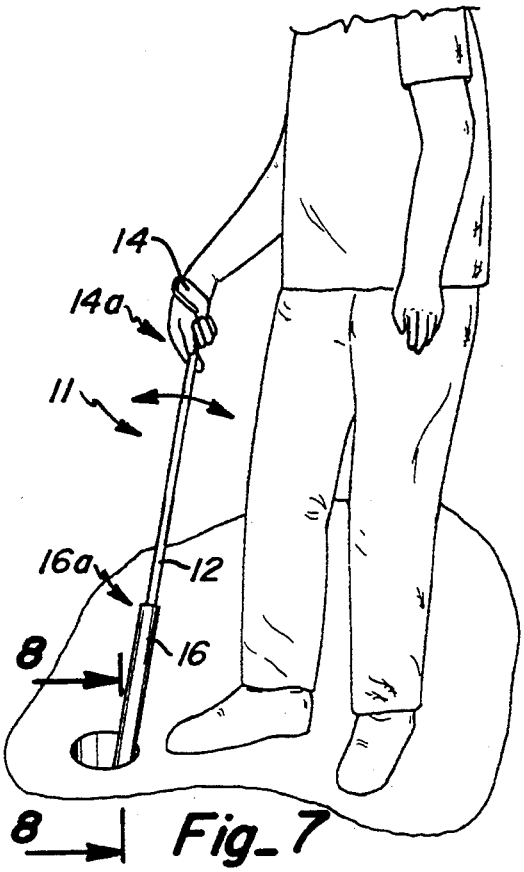
FIG. 7 is a partial perspective view illustrating a golfer lifting a ball from a ball cup with the clubhead pointing away from the user.
Figure 10:
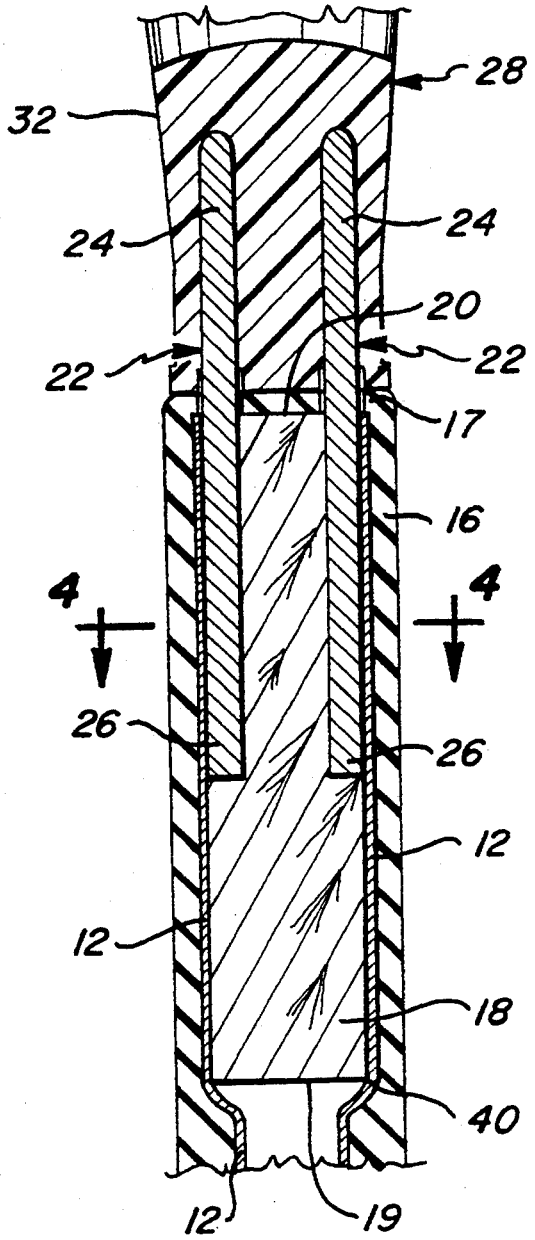
FIG. 10 is a partial vertical section, taken along line 10—10 of FIG. 2, showing the cooperation of the insert against the positive stop.
Figure 4:
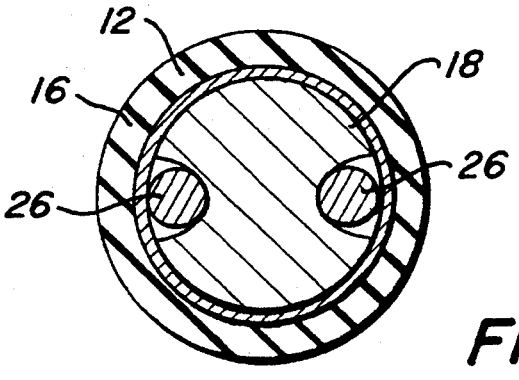
FIG. 4 is horizontal section, taken along the line 4—4 in FIG. 10, illustrating the cooperation of the prong member and the insert inside of the hollow shaft.

Having now described the essential components of apparatus 10 and the golf club assembly 11, its use is now described. The golfer, walks onto the green with a golf club assembly 11 and removes the ball lift/prong cover means 28 from the prongs 22 with one hand while holding the shaft 12 in the other. Then, while holding the clubhead 14 in his hand with the clubhead pointing towards him, as shown in FIG. 5, the golfer inserts the prong members 22 into the ground at a ball mark, and lifts and rotates the dirt and turf with the prong members, to repair the ball mark. The golfer then replaces the ball lift/prong cover means 281back onto the prongs 22 and may pack the dirt and turf with the clubhead 14. After sinking the putt, the golfer then lifts the ball 30 out of the hole (or cup) by holding the shaft 12 at the clubhead end 14*a* with the clubhead 14 pointing away from him.

To retrofit a conventional golf club to the present invention, a bore is first made in the top edge 17 of the grip. If the specification of the golf club is not available, the insert 18 is tapped into the hollow shaft 18 until it reaches a positive stop 40. Preferably, the insert 18 has preformed channels 21, and the second end 20 (adjacent to the channels) is the end tapped in. The insert 18 is marked (for size), pulled out, and cut at its marking. The cut point becomes the first end 19, which is then inserted into the shaft 12 and the insert 18 tapped into place. The prong members 22 are then tapped in with their first portion 26 rigidly disposed in the channels and their arcuate portions 24 extending past the top 17 of the handgrip. Sealing means (not shown) such as a suitable adhesive, may also provided and disposed between the insert 18, the first portions 26 and the inner wall of the shaft 12. The sealing means should be liquefiable upon applying heat, so that the insert 18 and the prong members 22 can be removed from the shaft 12 for maintenance and repair. A pair of apertures are punched into the top edge 17 of a replacement handgrip 16 for the prong members 22 to extend through when the replacement handgrip 16 is slid over the shaft 12.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. A combination ball lift and ball mark repair apparatus for a golf club having an elongated hollow shaft, a ball striking clubhead extending from a clubhead end of the shaft, and an elongated handgrip disposed about an opposite handgrip end of the shaft, the handgrip having an outer surface and a top edge, said apparatus comprising:

ball mark repair means extending from the top edge of the handgrip for lifting and turning dirt and turf to repair a ball mark when a user operates said apparatus by holding the golf club substantially at its clubhead end;

internal mounting means for rigidly mounting said ball mark repair means within the hollow shaft to the handgrip end of the golf club to allow the shaft to act as a handle extension which is resistant to torque and translational force produced by repairing a ball mark with said apparatus and which is sufficiently long to allow a user to operate said apparatus while the user is standing substantially upright; and ball lift means, removably mountable upon said ball mark repair means, for lifting a golf ball from a surface upon which the golf ball rests when a user operates said apparatus while holding the golf club substantially at its clubhead end;

wherein, said ball lift means also acts as a protective cover for said ball mark repair means when mounted thereon.

2. An apparatus, as claimed in claim 1, wherein:

said ball mark repair means and ball lift means are entirely contained within an imaginary cylindrical boundary extending from the outer surface of the handgrip at its top edge parallel to a longitudinal axis of the golf club.

3. An apparatus, as claimed in claim 2, wherein: said passageways adjoin the outer surface of the insert; and each of said first portions is sized to partially laterally extend beyond the outer surface of said insert and frictionally engage the inner wall of hollow club shaft to further secure the rigid engagement of said mounting means to the inner wall of the shaft.

4. An apparatus, as claimed in claim 2, wherein:

each of said prong members is cylindrical;

each of said prong member's first portions is straight along its length;

each of said prong member's second portions is arcuate along its length; and each of said prong receiving bores is arcuate along its length.

5. An apparatus, as claimed in claim 1, wherein:

said internal mounting means comprises an elongated insert having an outer surface and sized for being frictionally received within the hollow shaft, and a first and a second passageway longitudinally disposed along said insert;

said ball mark repair means comprises a pair of elongated prong members, each said prong member having a first portion frictionally disposed within one said longitudinal passageway and a second portion extending from said first portion a selectable length beyond the handgrip of the golf club to provide poking surfaces for lifting and turning dirt and turf; and said ball lift means comprises a prong member receiving base portion having a pair of bores therein, said bores located and configured to frictionally receive one said second portion of a respective prong member and having a bore length corresponding to the selected length of said second portion such that said base portion is mountable upon said prong second portions generally flush with the edge of the handgrip, and an arcuate ball lifting surface integral with said base portion to lift a golf ball thereon.

6. An apparatus, as claimed in claim 5, wherein:

each of said second portions extend away from the longitudinal axis of the shaft in a direction opposite to the direction in which the clubhead extends from the longitudinal axis of the shaft;

each of said bores extend in the same direction as said second portions; and said arcuate lifting surface faces the same direction in which the clubhead extends;

wherein the user thus repairs ball marks while holding the golf club at the clubhead end with the clubhead pointing towards the user and lifts a ball from a ball cup while holding the club at the clubhead end with the clubhead pointing away from the user.

7. An apparatus, as claimed in claim 1, wherein:

the inner wall of the hollow shaft narrows at a point along the longitudinal dimension to define a positive stop within the hollow shaft; and said internal mounting means is sized longitudinally such that a first end of said mounting means abuts the positive stop with an opposite second end of said mounting means disposed generally at the handgrip end of the golf club.

8. A golf club assembly comprising:

an elongated hollow shaft having an inner wall and a clubhead end and a handgrip end;

a ball striking clubhead extending from the clubhead end;

an elongated handgrip disposed about said handgrip end and having an edge and a first outer surface;

an elongated insert rigidly disposed within said hollow shaft at said handgrip end and having a second outer surface, first and second opposed ends, and a pair of longitudinal channels longitudinally disposed along said insert, said longitudinal channels originating at said first opposed end and terminating at a selectable terminal end point between said first and second opposed ends;

a pair of elongated prong members, each prong member having a first portion, having a third outer surface, rigidly disposed within one said longitudinal channel and abutting said terminal point of said channel, and a second portion extending from said first portion beyond the edge of said handgrip to provide a poking surface for lifting and turning dirt; and ball lift and prong cover means, slidably engaged over said second portions of said prong members, for lifting a golf ball from a golf ball cup and holding the golf ball thereon and for covering said second portions of said prong members to prevent injury and damage.

9. A golf club assembly, as claimed in claim 8, wherein each of said second portions extend in a direction opposite to the direction in which the clubhead extends from the shaft and wherein:

said ball lift and prong cover means comprises a base portion including a pair of bores therein, each bore located sized and configured to frictionally receive one said second portion and extending within said base portion in the same direction as its said received second portion such that said base portion is mountable upon said second portions generally flush with the edge of the handgrip; and an arcuate ball lifting surface integral with said base portion to cup and lift a golf ball thereon, said arcuate surface facing the same direction in which the clubhead extends;

wherein the user thus repairs ball marks while holding said golf club at the clubhead end with said clubhead pointing towards the user and lifts a ball from a ball cup while holding said club at the clubhead end with said clubhead pointing away from the user.

10. A golf club assembly, as claimed in claim 8, wherein:

said ball mark repair means and said ball lift and prong cover means are sized and cooperate to be entirely contained within an imaginary cylindrical boundary extending from the outer surface of said handgrip parallel to a longitudinal axis of said golf club.

11. A golf club assembly, as claimed in claim 10, wherein:

said first portion of each said prong members is generally straight;

said second portion of each said prong members is generally arcuate; and said prong receiving bores are generally arcuate.

12. A golf club assembly, as claimed in claim 8, wherein:

the inner wall of said hollow shaft narrows to define a positive stop;

said longitudinal channels are in communication with said outer surface of said insert;

said first end of said insert abuts said positive stop with said second end of said insert disposed at said handgrip end of said shaft; and a part of said outer surface of said first prong member portion laterally extending beyond its respective channel into frictional contact with the interior of said hollow shaft.

13. A golf club assembly, as claimed in claim 8, wherein:

said internal mounting means is comprised of a wood material;

said ball lift and cover means is comprised of a hardened plastic material; and said ball mark repair means is comprised of a metal or metal alloy material.

14. A method of manufacturing a golf club assembly comprising the steps of:

providing a golf club having an elongated hollow shaft having an inner wall, a clubhead end and an opposed handgrip end, a clubhead extending from the clubhead end and a handgrip disposed about the handgrip end and having a top edge;

providing an elongated insert having an outer surface, first and second opposed ends, and a pair of channels longitudinally disposed along the insert;

providing a pair of elongated prong members, each prong member having a first portion extendable into one of the passageways and a second portion extending from the first portion to provide a poking surface for lifting and turning dirt and turf;

inserting the insert by its first end, into the handgrip end of the hollow shaft so that the insert is rigidly positioned in the hollow shaft with its first end within the shaft and its second end generally adjacent to the handgrip end of the shaft;

inserting the first portion of each of the prong members into one of the passageways so that the first portion is rigidly positioned in the passageway with the second portion extendable beyond the handgrip end of the golf club;

providing ball lift and prong cover means for lifting a golf ball and for covering said second portions of said prong members to prevent injury and damage when mounted onto the prong members; and mounting the ball lift and prong cover means over the prong members.

15. A method, as claimed in claim 14, wherein:

the second portion is bent relative to the first portion;

the step of inserting the first portions includes orienting each of the prong members such that when its first portion is inserted, the second portion extends in the direction opposite to the direction which the clubhead extends;

the ball lift and prong cover means comprises a base portion including a pair of bores therein, each bore being located sized and configured to frictionally receive one respective second portion and extending within the base portion in the same direction the second portion it is to receive; and the step of mounting includes sliding the bores over the prongs such that the base portion is mounted upon the second portions generally flush with the handgrip end of the golf club.

16. A method, as claimed in claim 14, wherein:

the ball lift and cover means includes an arcuate ball lifting surface integral with the base portion for lifting the golf ball thereon, the arcuate surface facing the direction opposite to the direction in which the prong members extend; and the step of mounting results in the arcuate surface facing in the opposite direction to the direction in which the clubhead extends.

17. A method, as claimed in claim 14, wherein:

said ball mark repair means and said ball lift and prong cover means are laterally sized less than or equal diameter of the outer surface of the handgrip at the handgrip's top edge; and the steps of inserting the first portion and mounting result in the ball mark repair means and the ball lift means being entirely contained within an imaginary cylindrical boundary extending from the outer surface of said handgrip at the handgrip's top edge generally parallel to a longitudinal axis of the handgrip.

18. A method, as claimed in claim 14, wherein:

the inner wall of the hollow shaft narrows to define a positive stop; and the step of inserting the insert includes abutting the first end of the insert against the positive stop with the second end of the insert at the handgrip end of said shaft.

19. A method, as claimed in claim 14, wherein:

the longitudinal passageways are in communication with the outer surface of the insert;

the prong members are cylindrical and have a radius substantially equal to the radius of the passageways; and the step of inserting the first portions and inserting the insert results in each of the first portions frictionally contacting the inner wall of the hollow shaft.

* * * * *